US005842586A

United States Patent [19]

Melby

[11] Patent Number: 5,842,586

[45] **Date of Patent: *Dec. 1, 1998**

[54] HEIGHT ADJUSTABLE BED AND STORAGE UNIT FOR SMALL LIVING QUARTERS AND METHOD OF USE THEREOF

[76] Inventor: Gordon Melby, 158 W. Hilliard, Eugene, Oreg. 97404

[ * ] Notice: The terminal 4 months of this patent has been disclaimed.

[21] Appl. No.: 467,774

[22] Filed: Jun. 6, 1995

[51] Int. Cl.[6] ..... A47F 5/00

[52] U.S. Cl. ..... 211/187; 211/191; 5/10.1; 5/11

[58] Field of Search ..... 211/182, 189, 211/191, 187, 186, 90; 5/10.1, 11; 108/106, 107, 144

[56] References Cited

U.S. PATENT DOCUMENTS

| | | | |
|---|---|---|---|
| 1,411,260 | 4/1922 | Baker et al. | 108/107 |
| 3,199,471 | 8/1965 | Orsi | 211/187 X |
| 3,237,779 | 3/1966 | Eger | 211/191 |
| 3,475,769 | 11/1969 | Fasanella . | |
| 4,016,610 | 4/1977 | Ordonez . | |
| 4,056,196 | 11/1977 | Brauning | 211/187 X |
| 4,070,715 | 1/1978 | Reppas . | |
| 4,119,045 | 10/1978 | Michelotti | 211/186 X |
| 4,414,727 | 11/1983 | Steele | 5/10.1 X |
| 4,519,511 | 5/1985 | Mendenhall | 211/187 |
| 4,972,783 | 11/1990 | Crissman et al. | 108/107 |
| 5,012,938 | 5/1991 | King | 211/191 |
| 5,070,556 | 12/1991 | Gloger . | |
| 5,101,523 | 4/1992 | Bright . | |
| 5,176,435 | 1/1993 | Pipkens . | |
| 5,284,311 | 2/1994 | Baer | 211/191 X |

*Primary Examiner*—Robert W. Gibson, Jr.
*Attorney, Agent, or Firm*—William A. Birdwell & Associates

[57] ABSTRACT

A height adjustable bed and storage unit for small living quarters in which substantially vertical posts are fixedly attached to the floor and ceiling of the living quarters. Each post includes a mating structure for mating to a cross-member at a plurality of vertical positions, the cross-member being utilized for holding a platform substantially horizontally. The cross-member is releasable from the mating structure without the use of tools.

20 Claims, 5 Drawing Sheets

HEIGHT ADJUSTABLE BED AND STORAGE UNIT FOR SMALL LIVING QUARTERS AND METHOD OF USE THEREOF

BACKGROUND OF THE INVENTION

This invention relates to institutional furniture, particularly a height adjustable bed and storage unit for small living quarters.

In institutions, such as university dormitories, there is often a need to accommodate the living requirements of two occupants in a very small space. To utilize available space efficiently, a pair of bunk beds has often been provided wherein the bunk beds are constructed of a small number of simple wood components. This is so partly for reason of cost; however, wood also provides a "soft" aesthetic quality associated with the living areas of a home.

In such beds, space above the loft unit has generally remained unexploited. In addition, bunk beds are often stacked atop one another; thence, the loft unit is not as stable as is often desirable. Moreover, it is sometimes necessary to accommodate only one occupant, whereupon space either above the bunk unit or below the loft unit would ideally be utilized for storage; however, again, this space is generally not exploited in bunk beds. Further, it is often necessary to assemble and disassemble units quickly and repetitively, to accommodate a changing number of occupants and the differing preferences thereof.

Institutional furniture heretofore utilized for providing bedding and storage in small living quarters has not very well accommodated these needs. Designers of furniture of this type have generally relied on one of two schemes for the on-site joining of wood beams. A first installation scheme incorporates lag screws and threaded holes cut into the wood. However, the repeated installation and removal of lag screws degrades the threads, while the wood is weakened at the holes.

A second installation scheme comprises the insertion of one or more barrel nuts into laterally disposed holes drilled within a first elongate wood beam. The barrel nuts are oriented to receive corresponding machine bolts inserted through longitudinally disposed holes in the elongate first wood beam. The longitudinally disposed holes communicate with the laterally disposed holes and with corresponding coaxial holes in a second wood beam to create a butt type "T" or "J" joint between the wood beams.

At least two problems with this second installation scheme arise. First, the wood beams in which the barrel nuts are inserted are generally slender enough that the afore-described multiplicity of holes drilled therein can cause serious weakening. Second, access to the machine bolts attaching cross members in a bunk bed configuration must be had from outside of the bed. Generally at least one side and often two sides of the bed are against a wall so that access to at least some of these bolts requires moving the bed.

Still further, typical bunk units do not provide for adjustments in bed height that would, for example, allow a bunk unit to be adjusted to accommodate a handicapped person, for whom the height would ideally be at wheelchair seat level.

The present invention is directed to providing a height adjustable bed and storage unit for small living quarters that overcomes the aforementioned space utilization, repetitive assembly and adjustment disadvantages of institutional furniture heretofore available, while retaining the virtues of low cost and aesthetic appeal that have been traditionally provided in wooden bunk furniture.

SUMMARY OF THE INVENTION

In accordance with this invention, a height adjustable bed and storage unit for small living quarters is provided. The unit comprises a pair of substantially vertical posts fixedly attached in substantially parallel relationship at respective first and second ends thereof, each post having a longitudinally running channel extending substantially the length thereof. Each post includes provision for releasably fastening a support member to the post by capturing the support member within the longitudinal channel, the support member conforming substantially to the shape thereof. Each support member provides a resting top surface for a cross-rail captured, within the respective channels and above the respective support members, between the posts of the pair of posts. The cross-rails are adapted for the installation of a utility surface therebetween. The utility surface rests on ledges attached to the cross rails and may be utilized to support a mattress or alternatively may be used for storage or as a surface on which to work.

In accordance with other aspects of this invention, the provision of each post for capturing the support member is available at a plurality of predetermined height locations.

In accordance with still other aspects of this invention, the provision of each post for capturing the support member includes a pair of apertures wherein a first aperture of each pair passes through the post, beneath the longitudinal channel, while a second aperture of the pair passes through the post, from the first aperture to the channel. A threaded receptacle is contained within the first aperture and aligned with the axis of the second aperture. The support member has a support aperture therethrough, wherein a threaded fastener adapted for mating to the threaded receptacle may be installed.

In accordance with further aspects of this invention, the posts are fixedly attached to the floor and to the ceiling of the living quarters.

Therefore, it is a principal object of the present invention to provide a novel and improved height adjustable bed and storage unit for small living quarters and method of use thereof.

It is another object of the present invention to provide such a height adjustable bed and storage unit for small living quarters and method of use thereof which provides ease of height adjustment.

It is yet another object of the present invention to provide such a height adjustable bed and storage unit for small living quarters and method of use thereof which provides a height adjustment that may be accomplished quickly and repetitively.

It is still another object of the present invention to provide such a height adjustable bed and storage unit for small living quarters and method of use thereof which provides a height adjustment that will not degrade the bed and storage unit.

It is a further object of the present invention to provide such a height adjustable bed and storage unit for small living quarters and method of use thereof which provides a height adjustment having improved strength.

The foregoing and other objects, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
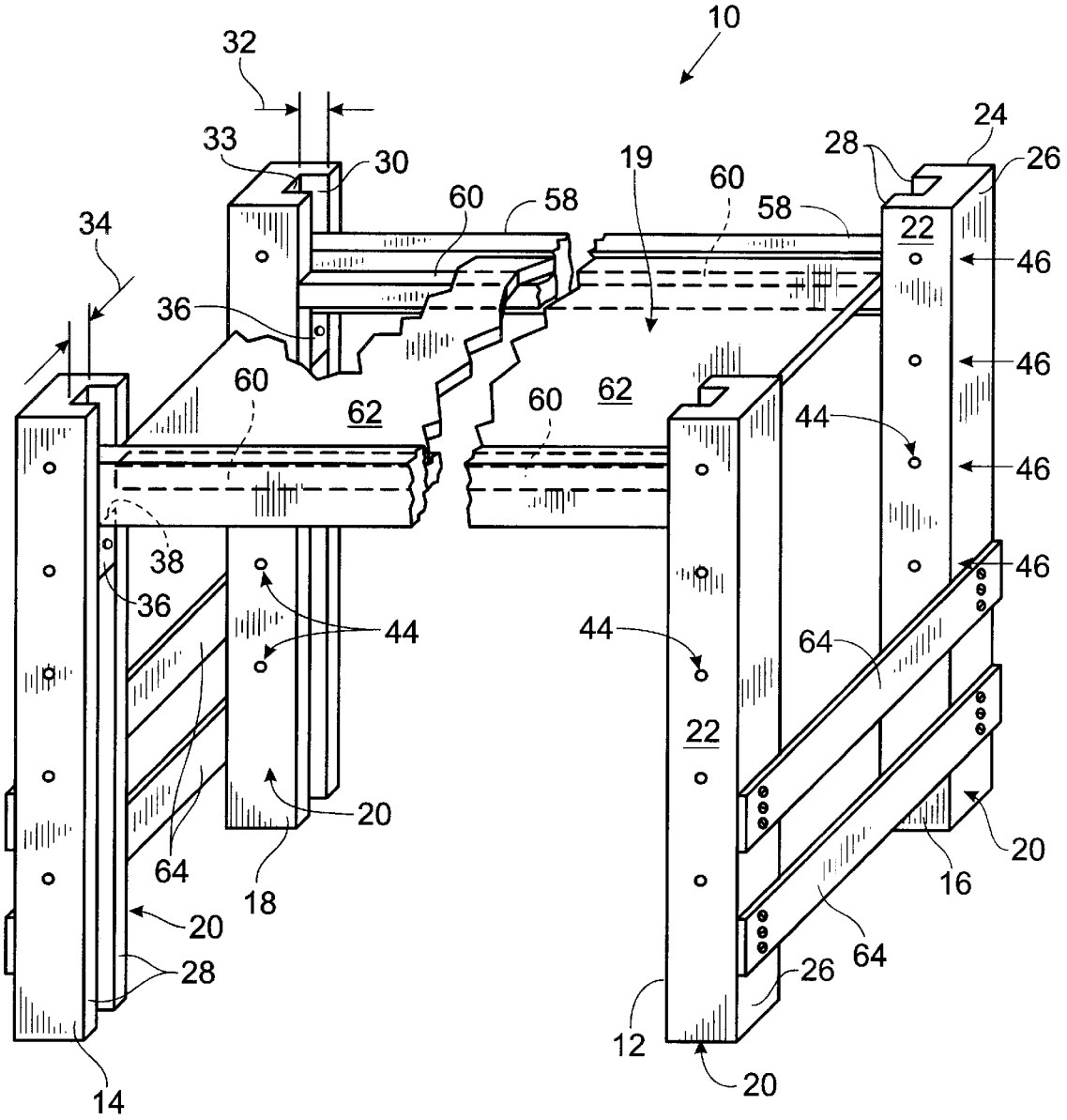
FIG. 1 is a pictorial view of a height adjustable bed and storage unit for small living quarters according to the present invention.

Referring to FIG. 1, a preferred embodiment of a height adjustable bed and storage unit for small living quarters 10 according to the present invention comprises a plurality of peripheral support (positions) such as a right-forward post 12, a left-forward post 14, a right-rear post 16 and a left-rear post 18. Preferably, posts 12, 14, 16 and 18 are nominally 4"×4" fir or pine. The posts are arranged so that they stand substantially vertically and form the corners of a horizontal rectangular bed space 19 that defines the desired plan dimensions of a bed.

Figure 2:
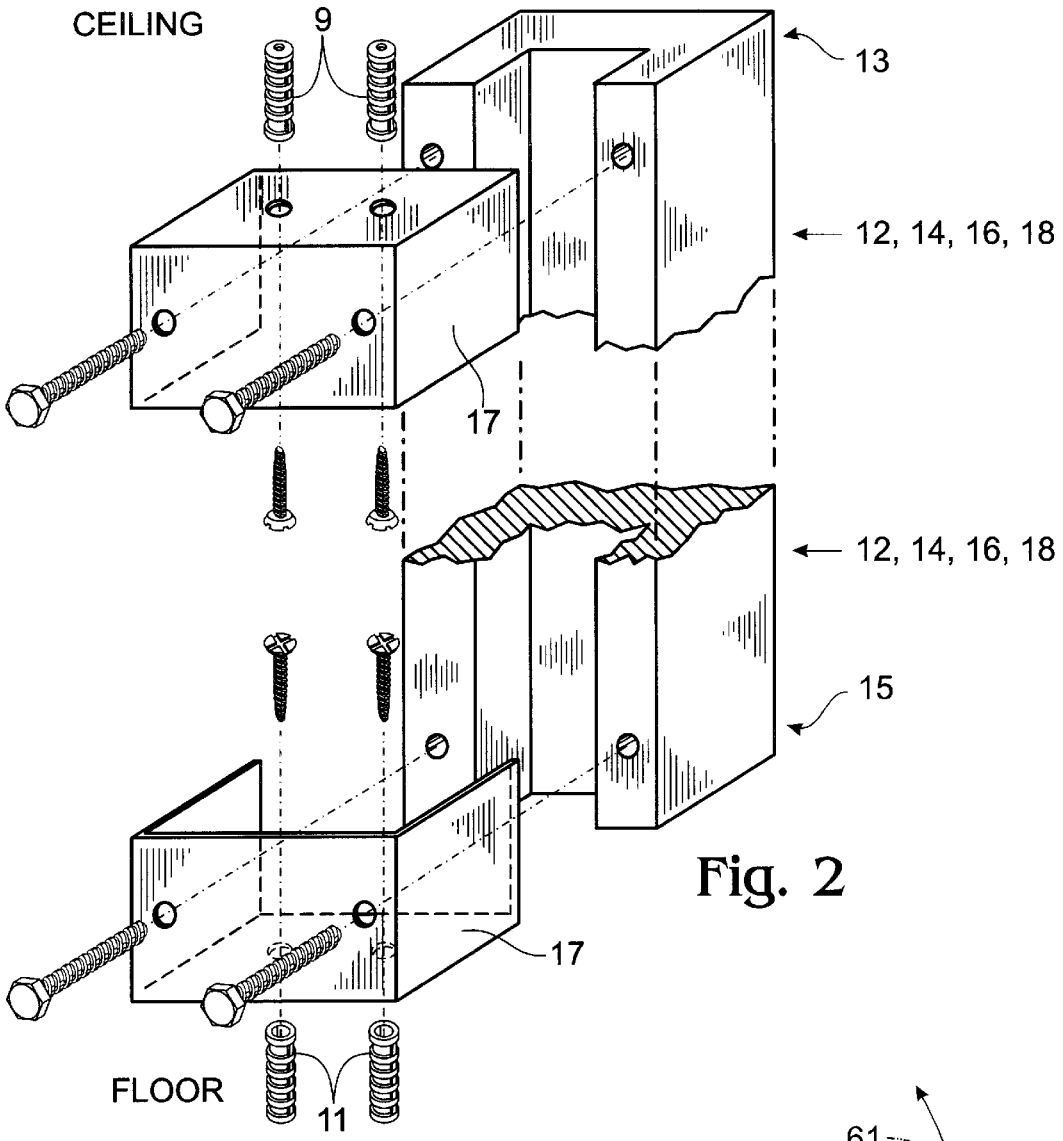
FIG. 2 is a pictorial view of a post anchored to the ceiling and floor of the living quarters, according to the present invention.

As shown in detail in FIG. 2, the posts 12, 14, 16 and 18 are attached, at respective first ends 13 and second ends 15 thereof, to post caps 17, wherein post caps 17 are further attached to anchors 9 and 11, which are attached to the ceiling and the floor of the living quarters, respectively, for securing the unit 10 to the living quarters and for providing a maximum of utilizable space. FIG. 2 shows a generic anchor which is commonly known in the art for installing a screw into a concrete surface, such as a concrete floor or ceiling; however, other types of anchors 9 and 11 may be adapted for installation into other construction materials as well are adapted for installation into a concrete ceiling and floor, however they may be adapted for installation into other construction materials as well.

Preferably, each of the posts 12, 14, 16 and 18 have four faces 20, each face 20 being oriented substantially 90 degrees from each neighboring face 20, the four faces 20 being referred to for purposes herein to aid in defining the structure of the unit 10. However, the posts 12, 14, 16 and 18 may have any number of faces more than two without departing from the principles of the present invention. The four faces 20 of the preferred embodiment consist of a front face 22, a rear face 24, an outside face 26 and an inside face 28 of each of the posts 12, 14, 16 and 18, wherein the meanings of front, rear, outside and inside are to be taken for purposes herein with respect to the posts 12, 14, 16 and 18 being in their aforementioned assembled positions. For purposes of explanation, "outside" is a direction facing away from the bed space 19 in the same direction as the major length thereof, while "front" corresponds to a direction from which the bed space 19 is normally or advantageously approached for access thereto.

Posts 12, 14, 16 and 18 each have a first mating structure 29 (not shown), such as a channel 30, the first mating structure being adapted for complementary joining with a second mating structure 31 described below. Although the channel 30 is the preferred embodiment of the first mating structure 29, the first mating structure may be male or female and may have other mating configurations. As will become more clear, the first mating structure 29 preferably remains unconstrained with respect to vertical movement relative to the second mating structure.

Preferably, the channel 30 runs longitudinally the entire length of each of the posts 12, 14, 16 and 18, the channel 30 extending into the respective post from the inside face 28 thereof a depth 32. The channel 30 has a rectangular cross section in which a channel back-surface 33 having a width 34 is substantially horizontal to and displaced from the inside face 28 of the posts 12, 14, 16 and 18. Alternatively, the posts may have no channel 30, so that the inside face 28 will function as the channel back-surface 33, or the channel may be incorporated in a bracket mounted on the inside face of the post, as shown in FIGS. 3B and 3C.

Figure 3A:
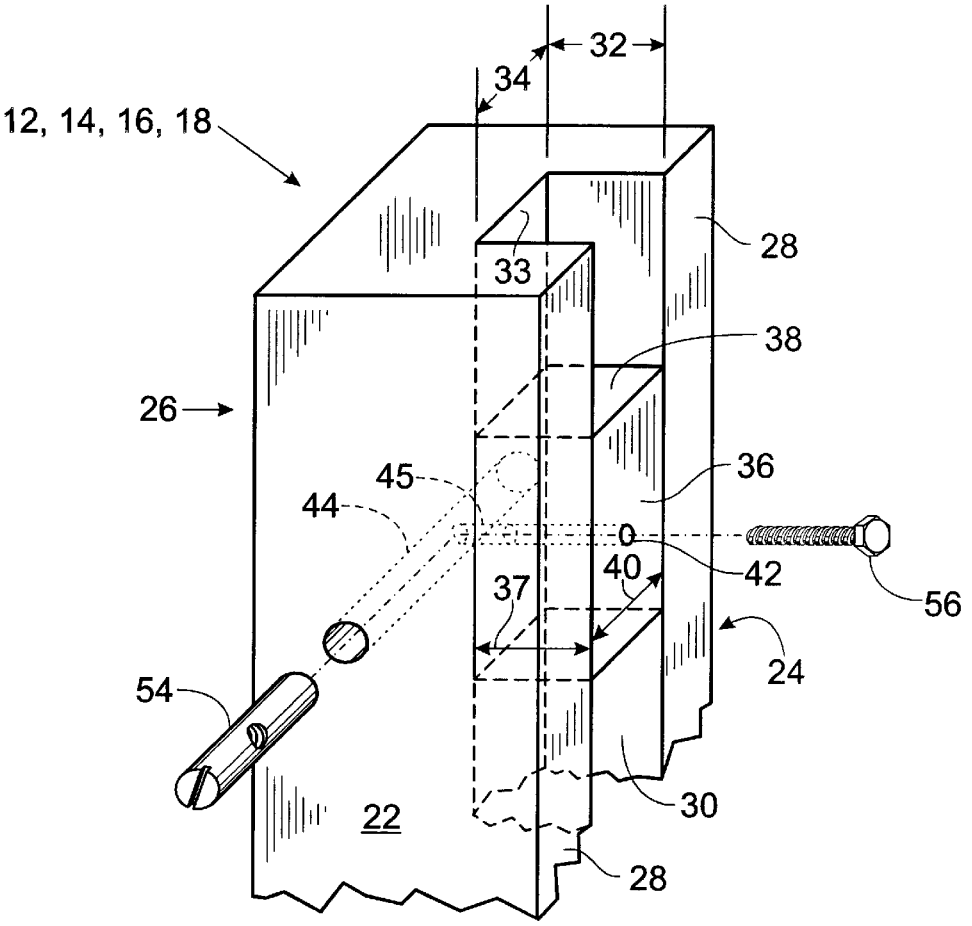
FIG. 3A is a pictorial view of a provision for attachment of a support member to a post, according to the present invention.
Figure 3C:
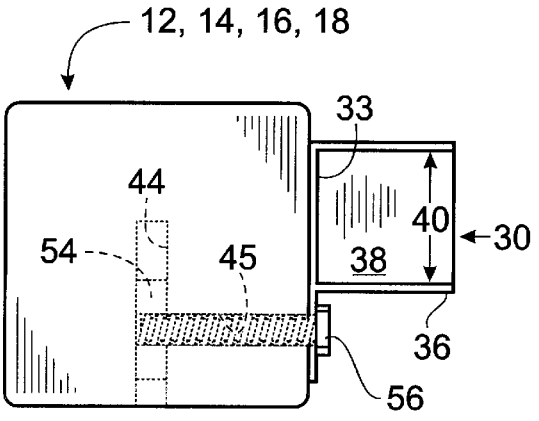
FIG. 3C is a pictorial top view of the alternative provision for attachment of FIG. 3B.
Figure 3B:
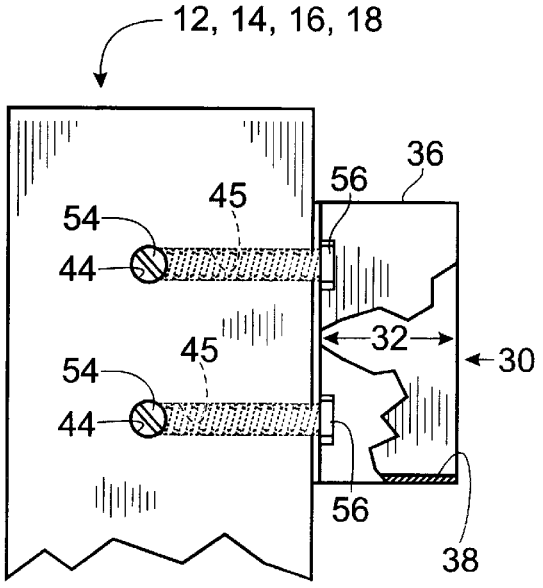
FIG. 3B is a pictorial side view of an alternative provision for attachment of a support member to a post, according to the present invention.

Referring to FIGS. 1 and 3, the channel 30 has a rectangular cross-section for receiving a support member 36 having a generally orthorhombic shape. The support member 36, when received by the channel 30, provides a top surface 38 that is substantially horizontal and flat. The support member 36 has a width 40, sized to fit within the receiving width 34 of the channel 30. The support member also has a depth 37, that is preferably equal to or less than the depth 32 of the channel 30. The depth 37 of the support member 36 may be greater than the depth 32, however this may pose a risk of injury if the support member 36 has sharp edges which thereby protrude from the channel 30.

The support member 36 includes a support aperture 42 therethrough which is substantially perpendicular to the direction defined by the width 40 of the support member 36. Preferably, the support aperture 42 is a cylindrical hole.

Each of the posts 12, 14, 16 and 18 includes provision for releasably fastening thereto the support member 36 when received by the channel 30 thereof. The provision includes a pair of apertures 44, 45 associated with, preferably, each of a plurality of predetermined vertical positions 46. There may be any number of predetermined vertical positions 46, including only one. A support member 36 is associated with each predetermined height location 46. Preferably, a first aperture 44 of the pair of apertures extends from the front face 22 of the post 12, 14, 16 and 18, through the post and to the rear face 24. The first aperture 44 may alternatively extend from either the front face 22 or the rear face 24 to a location 49 behind the back-surface 33 of the channel 30. The first aperture 44 is displaced from the channel 30, being behind the channel, toward the outside face of the post 12, 14, 16 and 18 and is substantially parallel to the direction defined by the width 34 of the channel 30.

The second aperture 45 of the pair of apertures extends from the channel back-surface 33, through the post 12, 14, 16 and 18, to meet the first aperture 44 in a direction substantially perpendicular to the first aperture 44. A threaded receptacle 54, such as a barrel-nut, is installed through and within the first aperture 44 at a location therein such that the threaded axis of the threaded receptacle 54 is concentric with the second aperture 45, the threaded receptacle thereby being behind the back-surface of the channel 30.

The threaded receptacle 54 is utilized in conjunction with a threaded fastener 56, preferably a machine bolt, passing through the support aperture 42 of the support member 36.

Figure 4:
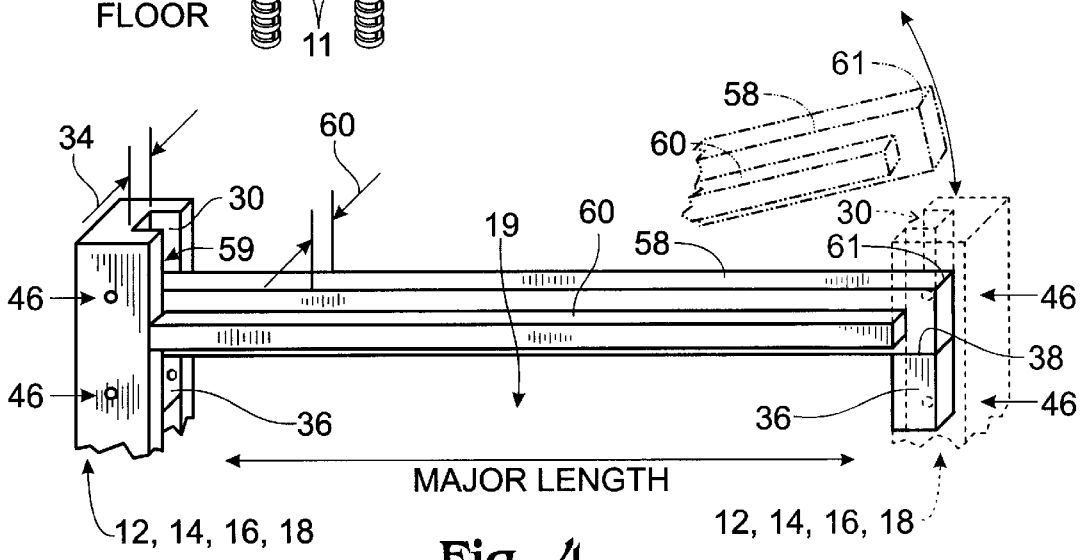
FIG. 4 is a pictorial view of a cross-rail and support members according to the present invention.

Referring to FIG. 4, the support members 36, being releasably attached to the posts 12, 14, 16 and 18 at selected predetermined vertical positions 46, provide top surfaces 38 for support of cross-members 58 resting thereon, each cross-member 58 extending between a pair of the posts 12, 14, 16 and 18 associated with the major length of the bed space 19. The cross-members 58 are secured to the posts by partial interlocking of a second mating structure 31 on the cross-members to the first mating structure 29 of the posts. Preferably, the second mating structure 31 (not shown) is a first end 59 or second end 61 of the cross-members 58 mating with the channel 30 of the posts 12, 14, 16 and 18. The second mating structure 31 must act in mating cooperation with the first mating structure 29 and, as noted above, preferably so that relative vertical movement remains unconstrained by either the first mating structure 29 or the second mating structure 31. However, the second mating structure 31 may be male or female and have other configurations than described as preferred. For example, the second mating structure 31 could be a channel and the first mating structure 29 could be a tongue. The first mating structure 29, the second mating structure 31 and the support members 36 together constrain movement of the cross-members 58 with respect to the posts 12, 14, 16 and 18 so that the cross-members may only move freely upwardly. The width 60 of the cross-members 58 must be less than the receiving width 34 of the channels 30 in order that the cross-members may be inserted into the channels and contained thereby at the ends 59 and 61. The cross-members 58 preferably comprise nominally 2"×4" fir or pine.

Figure 5:
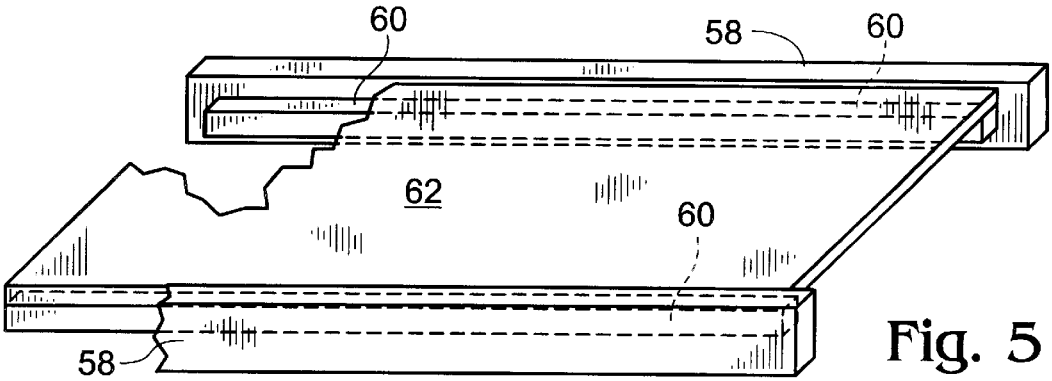
FIG. 5 is a pictorial view of a pair of cross-rails and a utility surface according to the present invention.

Referring to FIG. 5, the cross-members 58 have ledges 60 attached thereto for supporting a utility surface 62 between the cross-members 58. Ledges 60 are attached to the cross-members 58 by screws, or by other means readily apparent to those having ordinary skill in the art. The ledges 60 may be discrete pieces of wood, brackets or other like hardware, and may extend along the cross-rail any desired distance, however, preferably, the ledges 60 extend substantially the entire length of the cross-rail 58. A mattress may be placed upon the utility surface 62, or the utility surface 62 may be utilized for storage or as a surface on which to work.

Returning to FIG. 1, there are, preferably, five predetermined vertical positions 46 at which the support members 36 may be attached to the posts 12, 14, 16 and 18. These are chosen so that the utility surface 62 associated with the cross-members 58 may be held at, preferably, any of the following heights, measured from the floor of the living quarters: (1) a standard bed height of 18", (2) a hostel bed height of 26" for accommodating a handicapped person, (3) a desktop height of 30", (4) a loft bed height of 65", and (5) a storage height of 76". Other heights may be chosen, and more or fewer heights may be chosen, without departing from the principles of the invention.

Ladder steps 64 may be rigidly attached across two of the posts 12–18 defining the minor length of the bed space 19, at one or the other or both sides of the unit 10, to enable access to the loft height and the storage height.

The aforedescribed preferred embodiment of a bed and storage unit for small living quarters according to the present invention is preferably assembled as follows: The posts 12, 14, 16 and 18 are attached to the anchors 9 and 11 with, preferably, #6 sheet metal screws, at respective first ends 13 and second ends 15 of the posts, an anchor 9 being attached to the ceiling and an anchor 11 being attached to the floor of the living quarters as described above. The posts are arranged in parallel disposition to define the four corners of the rectangular bed space 19. Ladder steps 64 may be attached across two of the posts 12, 14, 16 and 18 defining the minor length of the bed space 19.

At least one support member 36 is releasably attached to each of posts 12, 14, 16 and 18 at a predetermined vertical location 46. A cross-member 58 is associated with each pair of posts defining the major dimension of the bed space 19. A first end 59 of a cross-member 58 corresponding to one of the pairs of posts 12, 14, 16 and 18 is first placed upon the top surface 38 of the support member 36 fastened to one of the posts of the pair. The first end 59 is caused to penetrate the channel 30 of that post.

Final assembly requires further that the second end 61 of the cross-member 58 penetrate the channel 30 of the other post of the pair of posts 12–18, thereby containing the ends 59 and 61 of the cross-member 58 within the channels 30 of each post of the pair. However, the cross-member 58 is longer than the space between the inside faces 24 of the pair of posts 12–18, so that, when lying horizontally, the cross-member 58 has its first end 59 and second end 61 protruding into and thereby contained within the depressions in the posts 12–18 composing the channels 30. Accordingly, the cross-member 58 must be angled, if it cannot be sufficiently bent, prior to inserting the second end 61 into the channel 30 of the other post of the pair of posts 12–18, with respect to the horizontal in order to bring the cross-member 58 into the vertical plane defined by the pair of posts 12, 14, 16 and 18 for this purpose (see FIG. 4). Consequently, the second end 61 of the cross-member 58 must be raised with respect to the already inserted first end 59 in order to bring the cross-member into the aforedescribed vertical plane. Thence, the second end 61 of the cross-rail 58 may be swung downwardly, onto the top surface 38 of a corresponding support member 36. An advantageous result of this procedure is that the cross-member is releasable from the post, for, e.g., height adjustment, without the use of tools. It should be noted that if a channel 30 is not employed or the support members 36 protrude from the inside face 28 of the posts, the need for the foregoing procedure is obviated.

It is to be recognized that, while a specific embodiment of a height adjustable bed and storage unit for small living quarters has been shown as preferred, variations thereof could be utilized without departing from the principles of the invention. For example, a second embodiment will be next described.

Figure 6:
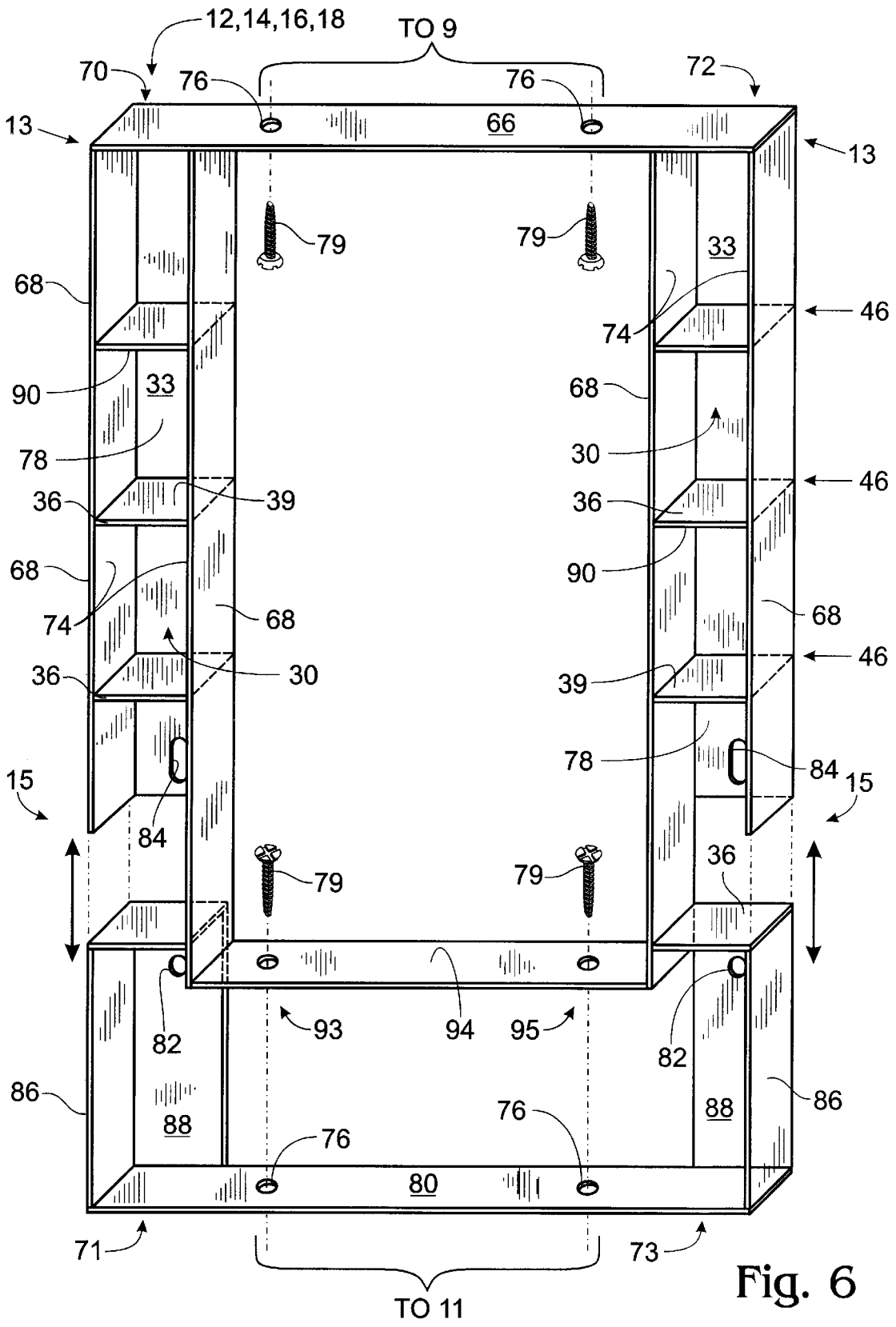
FIG. 6 is a pictorial view of a second embodiment of a post-portion of a height adjustable bed and storage unit for small living quarters according to the present invention, as viewed along direction A of FIG. 1.

Referring to FIG. 6, in a metal embodiment of the posts 12, 14, 16 and 18 according to the present invention, a pair of adjacent posts corresponding to the minor length of the bed space 19 are fixedly attached at respective first ends 13 thereof by a top support 66, and at respective second ends 15 thereof by a bottom support 94. Each of the pair of posts preferably comprises two flat metal plates 68 that are rigidly attached, as by welding, in parallel to the top support 66 and the bottom support 94, one of the pair of posts being attached, as by welding, at a first end 70 of the top support 66 and a first end 93 of the bottom support 94, and the other of the pair being attached, as by welding, at a second end 72 of the top support 66 and a second end 95 of the bottom support 94. 16 and 18 function as the aforedescribed channel 30. Support members 36 are fixedly and rigidly attached to the inside surfaces 74, as by welding, at a plurality of predetermined vertical positions 46. The support members 36 include a top surface 39 for supporting cross-members 58, the support members preferably being substantially flat metal plates. The support members 36 also aid in fixing the metal plates 68 in parallel relationship to one another. The posts 12, 14, 16 and 18 may include a third flat metal plate 78 attached perpendicularly to the parallel metal plates 68 to form the channel back-surface 33. It will be appreciated by one of ordinary skill in the art that flat metal plates 68 and support members 36 may be fixedly attached by means other than welding. The top support 66 includes apertures 76, such as holes, for attachment to the ceiling of the living quarters by threaded fasteners 79 extending through the holes 76 and into the anchors 9 installed in the ceiling.

Second ends 15 of the posts 12, 14, 16 and 18 are fixedly attached with a base support 80 wherein the base support 80 and its attachment to the posts may be a mirror image of the top support, or may provide for height adjustment for living quarters having differing heights from the floor to the ceiling as shown in FIG. 6. This latter provision preferably comprises a hole 82 in either the posts or the base support 80, and a vertical slot 84 in, respectively, the base support 80 or the posts, providing for vertical sliding movement between the base support 80 and the posts 12, 14, 16 and 18, the vertical sliding movement being locked by tightening the base support against the posts by means of a threaded fastener, inserted through the hole and slot, and a nut (not shown).

While a hole and slot are preferred, other aperture shapes may be employed for both the hole 82 and the slot 84 without departing from the principles of the invention. The base support 80 may then include perpendicular mounting portions 86 which fit either inside the channel 30 (as shown, with incorporated support members 36) or outside the posts as desired, wherein the perpendicular mounting portions are parallel to the metal plates 68 and may include a back-surface attachment portion 88 for attachment to the third metal plate 78 forming the channel back-surface 33. The back-surface attachment portions 88 include either the hole 82 or the slot 84, as desired. The base support 80 includes apertures, such as holes 76, for attachment to the floor of the living quarters by threaded fasteners 79 extending through the holes 76 and into the anchors 11 installed in the floor.

The space formed between the top surface 38 of one of the support members 36, a bottom surface 90 of the support member 36 (or the top support 66) immediately above the support member 36, and the inside surfaces 74 of the metal plates 68 may be identified as portions of the channel 30 or may alternatively be identified as an individual channel 30, so that a single channel 30 is perceived not to extend the entire length of the posts 12, 14, 16 and 18.

A metal embodiment of the cross-members 58, the ladder steps 64 and other components of the invention may also be constructed in any of a number of manners readily apparent to one of ordinary skill in the art.

Figure 7:
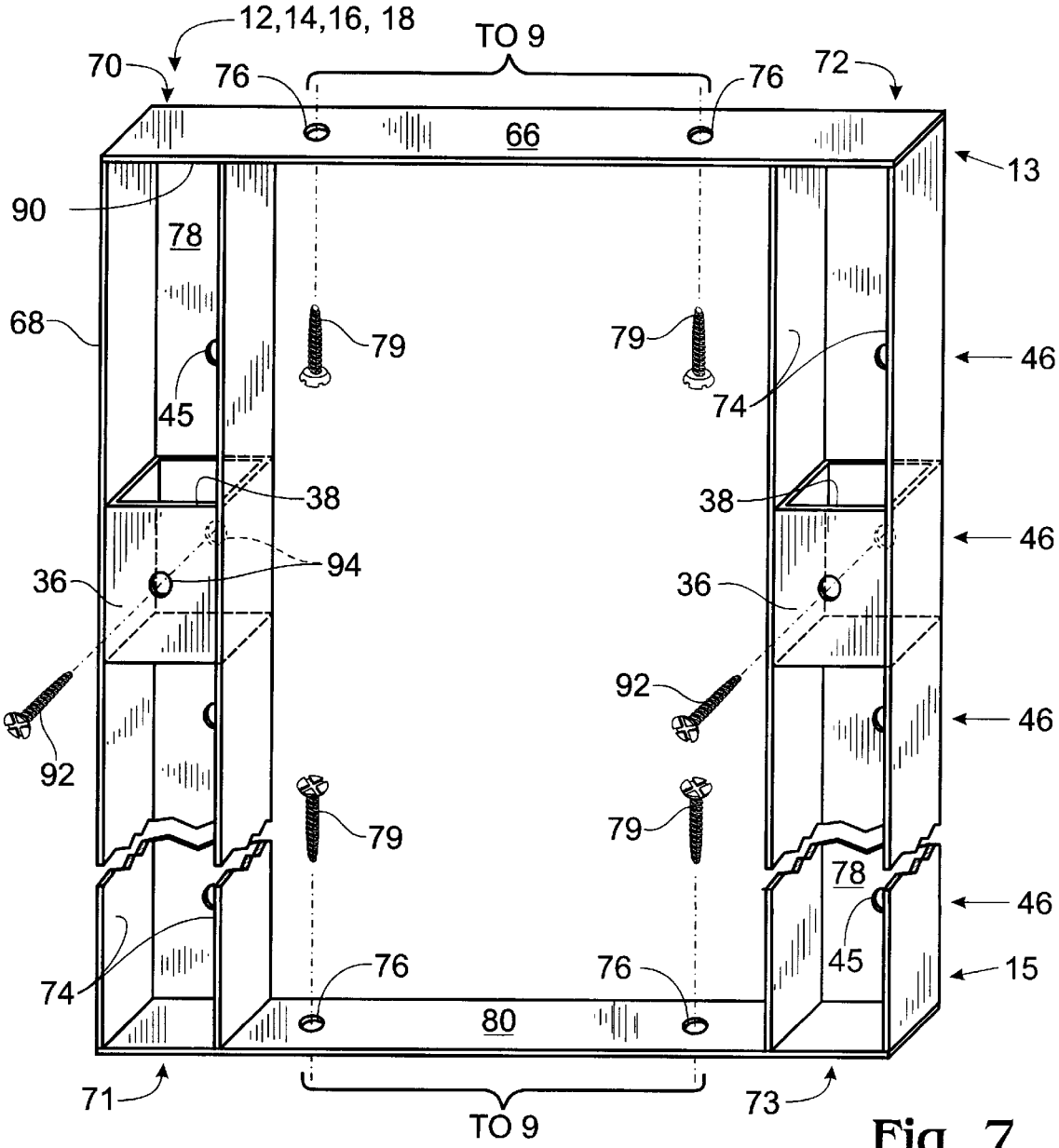
FIG. 7 is a pictorial view of a third embodiment of a post-portion of a height adjustable bed and storage unit for small living quarters according to the present invention, as viewed along direction A of FIG. 1.

Referring to FIG. 7, in a second metal embodiment of the posts 12, 14, 16 and 18 according to the present invention, a pair of adjacent posts corresponding to the minor length of the bed space 19 are fixedly attached at respective first ends 13 thereof by a top support 66, and at respective second ends 15 thereof by a bottom support 80. Each of the pair of posts preferably comprises two flat metal plates 68 that are rigidly attached, as by welding, in parallel to the top support 66 and the bottom support 80, one of the pair of posts being attached, as by welding, at a first end 70 of the top support 66 and a first end 71 of the bottom support 80, and the other of the pair being attached, as by welding, at a second end 72 of the top support 66 and a second end 73 of the bottom support 80. Inside surfaces 74 of the flat metal plates comprising the posts 12, 14, 16 and 18 function as the aforedescribed channel 30. Support members 36 are removably installed between the surfaces 74 as will be described below. Preferably, surfaces 74 are spacedapart slightly more than two inches, for receiving a support member 36 therebetween, the support member being a section of a two inch square tubing having a top surface 39. It will be apparent to one of ordinary skill in the art that other sizes and configurations of the support members 36, may be employed and that the distance between the surfaces 74 may be modified accordingly. The posts 12, 14, 16 and 18 preferably include a third metal plate 78 attached perpendicularly to the parallel metal plates 68 to form the channel back-surface. The third metal plate 78 includes an aperture 45 at a plurality of predetermined vertical positions 46, the aperture preferably a three-eights course threaded hole, for receiving a fastener 92, preferably a three-eights by two inch machine screw. The support member 36 include an aperture 94 aligned with the aperture 45 of the plate 78, the support member 36 being removably installed in the post 12, 14, 16 and 18 by threading the fastener 92 through the aperture 94 and into the aperture 45. However, it will be apparent to one of ordinary skill in the art that, alternatively, the aperture 45 may be in either of the flat metal plates 68 and the plate 78 may be omitted.

Both the top support 66 and the bottom support 80 include apertures 76, such as holes, for attachment to the ceiling of the living quarters by threaded fasteners 79 extending through the holes 76 and into the anchors 9 and 11 (not shown) installed in, respectively, the ceiling and the floor.

Referring back to the preferred, wood embodiment, further alternatives may be realized. For example, alternative methods of releasably fastening the support member 36 to the posts 12, 14, 16 and 18 could be utilized. For example, the first aperture 44 may not be displaced from the channel 30 and may instead align with a coaxial aperture in the support member 36, for attaching a bolt through the aperture 44, directly into the support member 36, in the direction of front to rear. Moreover, the support member 36 may be provided with a downwardly depending pin for insertion into the second aperture 45 wherein the second aperture 45 is commensurately angled downwardly to prevent the support member 36 from backing out of the post.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A height adjustable bed and storage unit for small living quarters, comprising:

a cross-member for supporting a platform substantially horizontally, said cross-member having an end, said platform having a plurality of peripheral support positions;

at least one post corresponding to a peripheral support position of said platform, said post including one or more end members adapted for anchoring to at least one of the floor and the ceiling of the living quarters, so as to hold said post in a substantially fixed, vertical position; and at least one support member adapted to releasably support said end of said cross-member at said post at any of a plurality of vertical positions, said platform also being supported at other peripheral support positions by one or more members distinct from said post, said cross-member being adapted to release from said support member by pivoting said cross-member upwardly.

2. A height adjustable bed and storage unit for small living quarters, comprising:

a cross-member for supporting a platform substantially horizontally, said platform having a plurality of peripheral support positions;

at least one post corresponding to a peripheral support position of said platform;

at least one anchor associated with said post for holding said post in a substantially fixed, vertical position; and at least one support member adapted to releasably attach said cross-member to said post at any of a plurality of vertical positions so as to support said platform substantially horizontally, said platform also being supported at other peripheral support positions by one or more members distinct from said post, wherein said post has an upper end and a lower end, a first anchor attached to said upper end and to the ceiling of the living quarters.

3. The adjustable bed and storage unit of claim 2, wherein a second anchor is attached to said lower end of said one post and to the floor of the living quarters.

4. The adjustable bed and storage unit of claim 1 wherein a first pair of said posts defines a major length of a bed space, at least one anchor being associated with each post of said first pair, for holding each post of said first pair in a substantially fixed, vertical position.

5. The adjustable bed and storage unit of claim 4 wherein a second pair of posts defines, with said first pair of posts, a bed space, at least one anchor being associated with each post of said second pair, for holding each post of said second pair in a substantially fixed, vertical position.

6. The adjustable bed and storage unit of claim 1 wherein each of said posts includes a first mating structure, for mating to a complementary second mating structure of said cross-member.

7. The adjustable bed and storage unit of claim 6 wherein said first mating structure is a channel extending substantially the length of said post.

8. The adjustable bed and storage unit of claim 7 wherein said second mating structure is an end of said cross-member, so that mating of said cross-member to said post is by penetration of said end of said cross-member into said channel of said post.

9. The adjustable bed and storage unit of claim 7 having a plurality of support members, each support member associated with a different one of said plurality of vertical positions.

10. A height adjustable bed and storage unit for small living quarters, comprising:

a cross-member for supporting a platform substantially horizontally, said platform having a plurality of peripheral support positions;

at least one post corresponding to a peripheral support position of said platform;

at least one anchor associated with said post for holding said post in a substantially fixed, vertical position; and at least one support member adapted to releasably attach said cross-member to said post at any of a plurality of vertical positions so as to support said platform substantially horizontally, said platform also being supported at other peripheral support positions by one or more members distinct from said post, wherein said post includes a first mating structure, for mating to a complementary second mating structure of said cross-member, wherein said first mating structure is a channel extending substantially the length of said post, wherein the bed and storage unit has a plurality of support members, each support member being associated with a different one of said plurality of vertical positions, and wherein said support members are fixed to said post.

11. The adjustable bed and storage unit of claim 10, wherein said support members are substantially flat metal plates and are welded to said channels.

12. A height adjustable bed and storage unit for small living quarters, comprising:

a cross-member for supporting a platform substantially horizontally, said platform having a plurality of peripheral support positions;

at least one post corresponding to a peripheral support position of said platform;

at least one anchor associated with said post for holding said post in a substantially fixed, vertical position; and at least one support member adapted to releasably attach said cross-member to said post at any of a plurality of vertical positions so as to support said platform substantially horizontally, said platform also being supported at other peripheral support positions by one or more members distinct from said post, wherein said post includes a first mating structure, for mating to a complementary second mating structure of said cross-member, wherein said first mating structure is a channel extending substantially the length of said post, wherein the bed and storage unit has a plurality of support members, each support member being associated with a different one of said plurality of vertical positions, and wherein said support members are releasably attached to said channels.

13. The adjustable bed and storage unit of claim 11, wherein each of said posts includes at least one pair of apertures, said pair of apertures being associated with one of said plurality of vertical positions, wherein a first aperture of said pair extends through said post, behind said channel, and a second aperture extends from said channel, through said post, to meet said first aperture, a threaded receptacle being disposed within said first aperture so that a threaded axis of said threaded receptacle is substantially concentric with said second aperture, and said threaded receptacle receives a threaded fastener passing through a support aperture in said support member for releasably fastening said support member to said post.

14. A height adjustable bed and storage unit for small living quarters, comprising:

a pair of cross-members for supporting a platform substantially horizontally, said platform having a plurality of peripheral support positions;

a pair of posts corresponding to an associated pair of peripheral support positions of said platform;

at least one anchor associated with each post of said pair for holding each post in a substantially fixed, vertical position; and a pair of support members adapted to releasably attach said pair of cross-members to associated posts of said pair of posts at any of a plurality of vertical positions so as to support said platform substantially horizontally, said platform also being supported at other peripheral support positions by one or more members distinct from said pair of posts wherein said pair of posts defines a major length of a bed space, wherein at least one anchor is associated with each post of said pair for holding each post in a substantially fixed, vertical position, wherein each post of said pair of posts includes a channel extending substantially the length thereof, wherein each post of said pair further includes a corresponding plurality of pairs of apertures associated with said plurality of vertical positions, wherein a first aperture of each of said pairs of apertures extends through the respective said post, behind the respective said channel, and wherein a second aperture extends from the respective said channel, through the respective said post, to meet said first aperture, a threaded receptacle being disposed within said first aperture so that a threaded axis of said threaded receptacle is substantially concentric with said second aperture, wherein said threaded receptacle receives a threaded fastener passing through a support aperture in said support member for releasably fastening said support member to the respective said post, and wherein each cross-member of said pair of cross-members is placed on the corresponding said support member so that an end thereof penetrates the respective said channel.

15. The adjustable bed and storage unit of claim 14, wherein at least one of said posts includes an attachment to a first anchor at an upper end thereof, said first anchor being attached to the ceiling of the living quarters, and wherein at least one of said posts includes an attachment to a second anchor at a lower end thereof, said second anchor being attached to the floor of the living quarters.

16. A method for constructing an adjustable bed and storage unit for small living quarters having a floor and a ceiling, comprising the steps of:

attaching at least one post substantially vertically between at least one of the floor and the ceiling of the living quarters, so as to hold said post in a substantially fixed, vertical position;

selecting from one of a plurality of different vertical support positions on said post;

providing a support mechanism at the selected said vertical support position; and releasably attaching to said post by said support mechanism one end of a cross-member for supporting a platform substantially horizontally at the selected said vertical position, the other end of said cross-member being independently supported.

17. The method of claim 16, wherein said post includes a channel extending substantially the length thereof, wherein said support mechanism includes at least one pair of apertures, said pair of apertures being associated with one of said plurality of vertical positions on said post, wherein a first aperture of said pair extends through said post, behind said channel, and wherein a second aperture extends from said channel, through said post, to meet said first aperture, a threaded receptacle being disposed within said first aperture so that a threaded axis of said threaded receptacle is substantially concentric with said second aperture, and further comprising the steps of inserting a threaded fastener through a support aperture in said support member and through said second aperture, and threading said threaded fastener into said threaded receptacle.

18. The method of claim 16, wherein said support mechanisms are fixedly attached into said channel.

19. The method of claim 18, wherein said support member is a substantially flat metal plate, and wherein said support member is fixedly attached into said channel by welding said metal plate to said channel.

20. The method of claim 16, wherein said post includes a channel, and wherein releasably attaching said cross-member to said post includes the step of inserting an end of said cross-member into said channel.

* * * * *

UNITED STATES PATENT AND TRADEMARK OFFICE

CERTIFICATE OF CORRECTION

PATENT NO. : 5,842,586
DATED : December 1, 1998
INVENTOR(S) : Gordon Melby

It is certified that error appears in the above-identified patent and that said Letters Patent is hereby corrected as shown below:

Title page,
Below Item [76], Inventor, insert the following:

-- [73] Assignee: University of Oregon, Eugene, Oregon --.

Signed and Sealed this

Twenty-fourth Day of August, 2004

JON W. DUDAS
*Director of the United States Patent and Trademark Office*